US010007228B2

(12) United States Patent
Tsukada

(10) Patent No.: US 10,007,228 B2
(45) Date of Patent: Jun. 26, 2018

(54) IMAGE FORMING APPARATUS

(71) Applicant: Brother Kogyo Kabushiki Kaisha, Nagoya-shi, Aichi-ken (JP)

(72) Inventor: Takamasa Tsukada, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/710,901

(22) Filed: Sep. 21, 2017

(65) Prior Publication Data

US 2018/0095407 A1 Apr. 5, 2018

(30) Foreign Application Priority Data

Oct. 4, 2016 (JP) ..... 2016-196788

(51) Int. Cl.
*G03G 15/00* (2006.01)
*G03G 21/16* (2006.01)

(52) U.S. Cl.
CPC ..... *G03G 21/1633* (2013.01); *G03G 21/1647* (2013.01); *G03G 21/1666* (2013.01); *G03G 2221/1687* (2013.01)

(58) Field of Classification Search
USPC ..... 399/107, 108, 110, 111, 114, 118; 347/118
See application file for complete search history.

(56) References Cited

U.S. PATENT DOCUMENTS 7,840,159 B2 * 11/2010 Nakashima ..... G03G 15/326 399/110
8,150,294 B2 * 4/2012 Okabe ..... G03G 15/0131 399/110
8,755,715 B2 * 6/2014 Mori ..... G03G 21/1633 347/118
9,031,454 B2 5/2015 Nakamura
2014/0044450 A1 2/2014 Nakamura

FOREIGN PATENT DOCUMENTS

JP 2007-065125 A 3/2007
JP 2010-044406 A 2/2010
JP 2012-088480 A 5/2012
JP 2014-035375 A 2/2014

* cited by examiner

*Primary Examiner* — Hoan Tran
(74) *Attorney, Agent, or Firm* — Banner & Witcoff, Ltd.

(57) ABSTRACT

An image forming apparatus, having a main body, a top cover, a first exposure device, a second exposure device, and a linkage mechanism, is provided. The top cover is pivotable about a first pivot axis. The first exposure device and the second exposure device are supported by the top cover pivotably about a second pivot axis and a third pivot axis, respectively. The second exposure device is at a position closer to the first pivot axis than the first exposure device. The linkage mechanism moves the first exposure device from a first retracted position toward a first exposing position and the second exposure device from a second retracted position toward a second exposing position in conjunction with the top cover moving between a first position and a second position. The linkage mechanism moves the first exposure device at a timing later than the second exposure device.

7 Claims, 8 Drawing Sheets

1
2
3
4
5
5(5a)
5(5b)
5(5c)
5(5d)
6
31
32
33
33a
33b
34
34a
34b
35
35a
35b
36
36a
36b
52(52a)
52(52b)
52(52c)
52(52d)
53(53a)
53(53b)
53(53c)
53(53d)
54(54a)
54(54b)
54(54c)
54(54d)
55a
55b
55c
55d
61
72
72a
72b 1
2
3
4
5
5(5a)
5(5b)
5(5c)
5(5d)
6
31
32
33
33a
33b
34
34a
34b
35
35a
35b
36
36a
36b
52(52a)
52(52b)
52(52c)
52(52d)
53(53a)
53(53b)
53(53c)
53(53d)
54(54a)
54(54b)
54(54c)
54(54d)
55a
55b
55c
55d
61
72
72a
72b

IMAGE FORMING APPARATUS

CROSS REFERENCE TO RELATED APPLICATION

This application claims priority from Japanese Patent Application No. 2016-196788, filed on Oct. 4, 2016, the entire subject matter of which is incorporated herein by reference.

BACKGROUND

Technical Field

An aspect of the present invention is related to an image forming apparatus for forming images in an electro-photographic style.

Related Art

An image forming apparatus having a main body and a cover attached to the main body is known. The main body may have an opening on an upper side thereof, and the cover may be pivotably supported by the main body to pivot about a pivot shaft at the upper side of the main body to cover and uncover the opening.

The image forming apparatus may include a drum unit, including a photosensitive drum, and an exposure device to emit light at the photosensitive drum. The drum unit may be accommodated inside the main body, and the exposure device, e.g., an LED exposure unit, may be attached to the top cover.

The image forming apparatus may be equipped with a plurality of LED units attached to the top cover aligning in line. Each of the LED units may be supported pivotably by the top cover at a basal end thereof, and a tip end of the LED unit being an opposite end to the basal end may move between an exposing position, in which the tip end is separated farther from the top cover, and a retracted position, in which the tip end is closer to the top over.

The image forming apparatus may further be equipped with a linkage mechanism, which may move the LED units from the exposing positions to the retracted positions at the same timing as the top cover being moved to pivot from an open position to a closed position.

SUMMARY

While the LED units may emit light at the photosensitive drums to expose the photosensitive drums to the light, it may be preferable to keep the LED units clean. Meanwhile, among the plurality of LED units aligning in line, some of the LED units that are located farther from the pivot shaft of the top cover may be located closer to a user when the top cover is in the open position. Therefore, the closer LED units may be more easily touched unintentionally or accidentally by the user who attempts to reach inside the main body and may not be kept clean.

The present disclosure is advantageous in that an image forming apparatus having exposure devices, such as LED units, in which the exposure devices may be prevented from being tainted, is provided.

According to an aspect of the present disclosure, an image forming apparatus configured to form an image electro-photographically is provided. The image forming apparatus includes a main body having an opening portion at an upper side thereof; a top cover including a first end portion and a second end portion opposite to the first end portion, the top cover being supported by the main body at the first end portion pivotably about a first pivot axis, the top cover being configured to move the second end portion between a first position, in which the top cover covers the opening portion, and a second position, in which the top cover exposes the opening portion; a first exposure device supported by the top cover at a basal end portion of the first exposure device pivotably about a second pivot axis, the second pivot axis extending in parallel with the first pivot axis, the first exposure device being configured to move between a first exposing position, in which a tip end portion of the first exposure device opposite to the basal end portion is separated farther from the top cover, and a first retracted position, in which the tip end portion of the first exposure device is closer to the top cover; a second exposure device arranged at a position closer to the first pivot axis than the first exposure device, the second exposure device being supported by the top cover at a basal end portion of the second exposure device pivotably about a third pivot axis, the third pivot axis extending in parallel with the first pivot axis, the second exposure device being configured to move between a second exposing position, in which a tip end portion of the second exposure device opposite to the basal end portion is separated farther from the top cover, and a second retracted position, in which the tip end portion of the second exposure device is closer to the top cover; and a linkage mechanism linked with the first exposure device and with the second exposure device, the linkage mechanism being configured to move the second exposure device from the second retracted position toward the second exposing position and move the first exposure device from the first retracted position toward the first exposing position at a timing later than the second exposure device moving toward the second exposing position in conjunction with the top cover moving from the second position toward the first position.

BRIEF DESCRIPTION OF THE ACCOMPANYING DRAWINGS

Figure 4A:
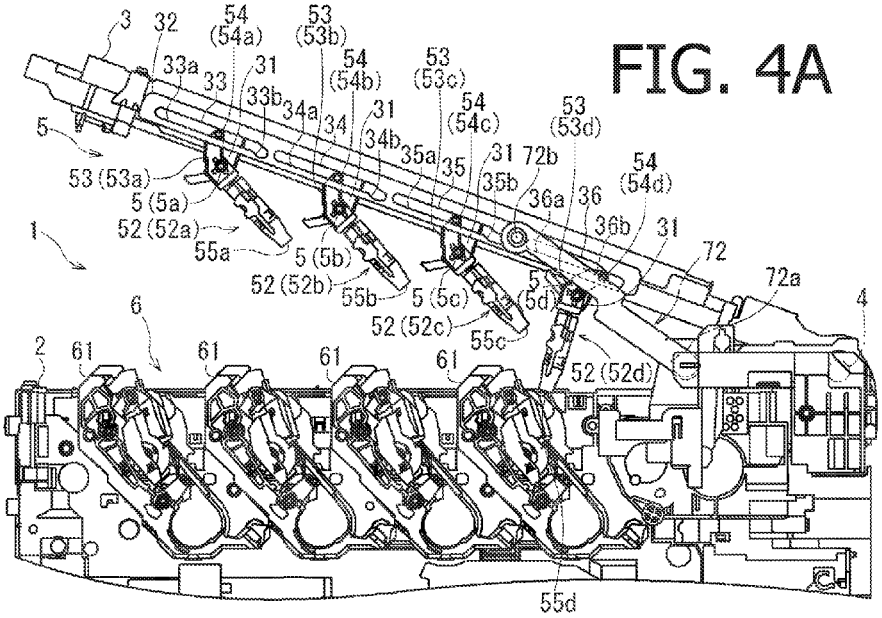
Figure 4B:
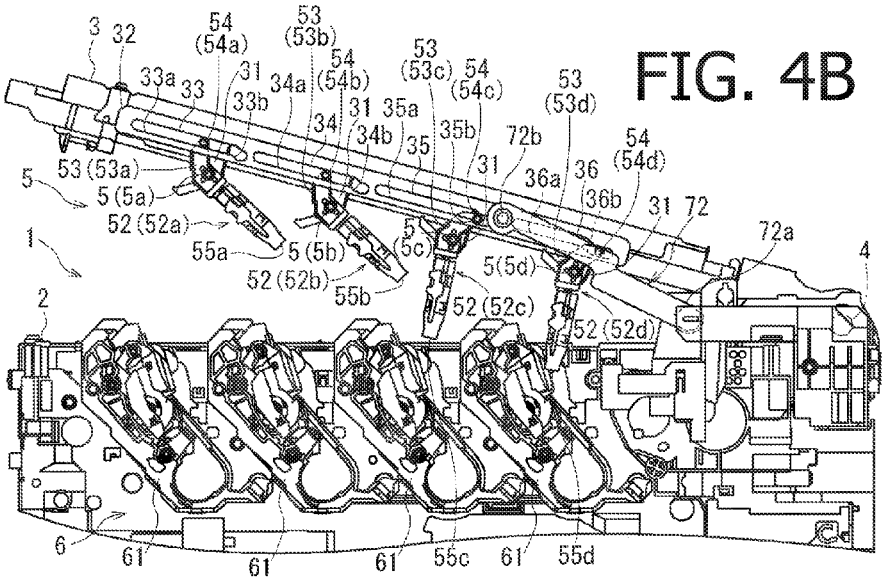

FIG. 4A is a sideward view of the image forming apparatus according to the first embodiment of the present disclosure with the top cover at an intermediate position moved from the second position toward a first position and a fourth LED array moved from a retracted position to an exposing position. FIG. 4B is a sideward view of the image forming apparatus according to the first embodiment of the present disclosure with the top cover at another intermediate position moved further toward the first position and a third LED array moved from a retracted position to an exposing position.

Figure 5A:
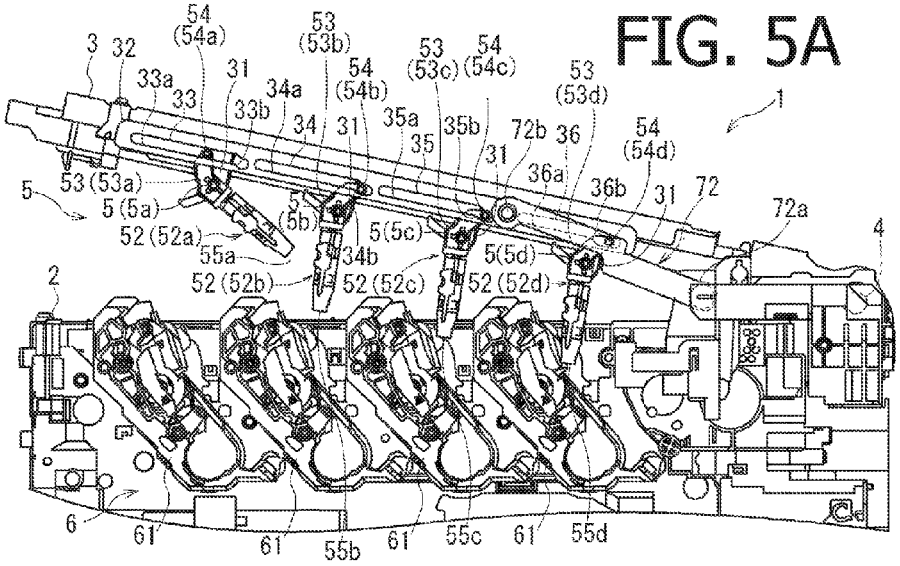
Figure 5B:
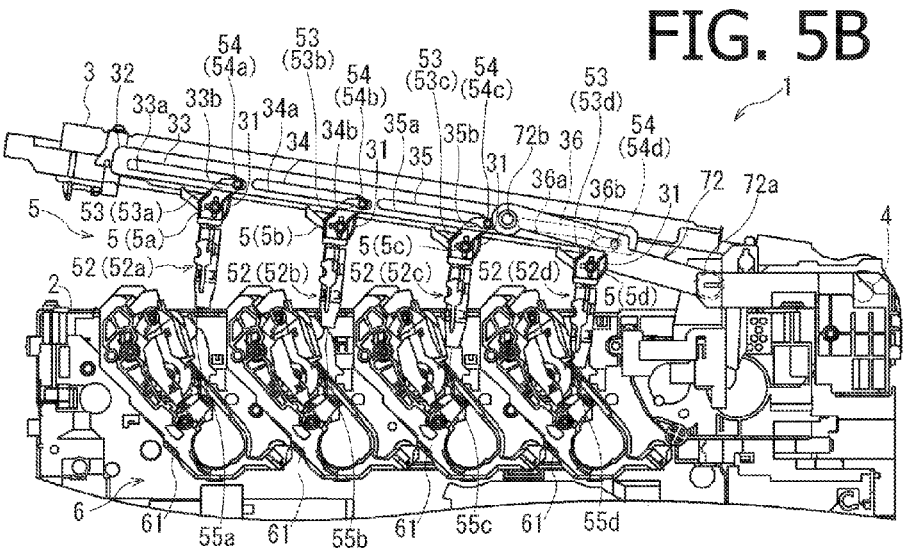

FIG. 5A is a sideward view of the image forming apparatus according to the first embodiment of the present disclosure with the top cover at another intermediate position moved further toward the first position from the position in FIG. 4B and a second LED array moved from a retracted position to an exposing position. FIG. 5B is a sideward view of the image forming apparatus according to the first embodiment of the present disclosure with the top cover at another intermediate position moved further toward the first position from the position in FIG. 5A and a first LED array moved from a retracted position to an exposing position.

Figure 6:
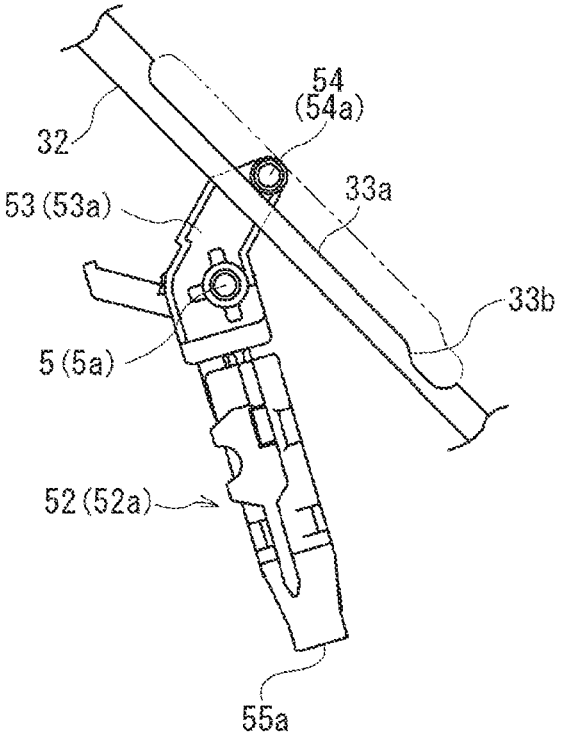

FIG. 6 is a sideward view of an exemplary linear-motion plate having at least a retainer cam edge and a pivoting cam edge in the image forming apparatus according to the first embodiment of the present disclosure.

Figure 7A:
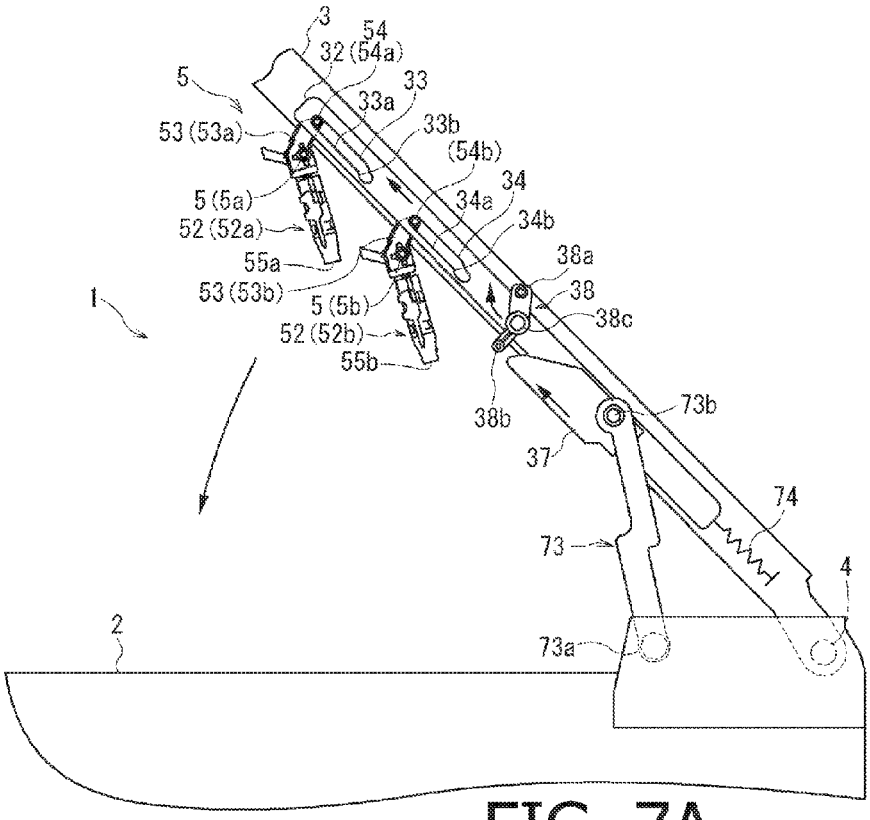
Figure 7B:
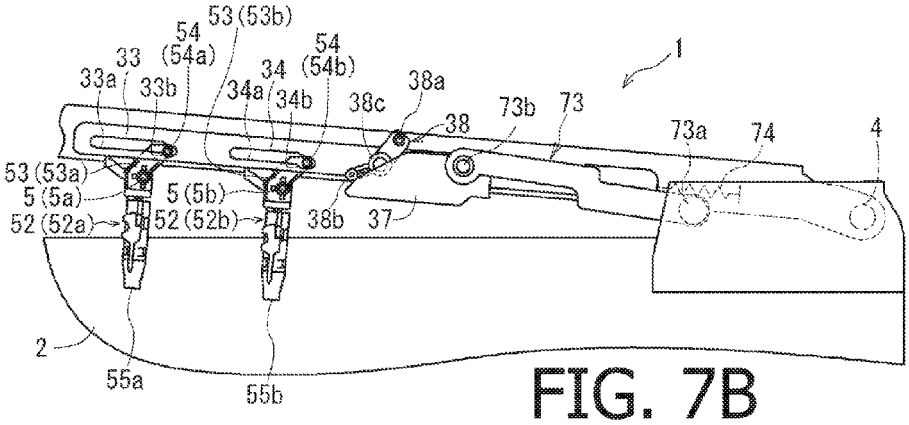

FIGS. 7A-7B are sideward views of a movable mechanism for the LED arrays in the image forming apparatus according to a second embodiment of the present disclosure.

Figure 8A:
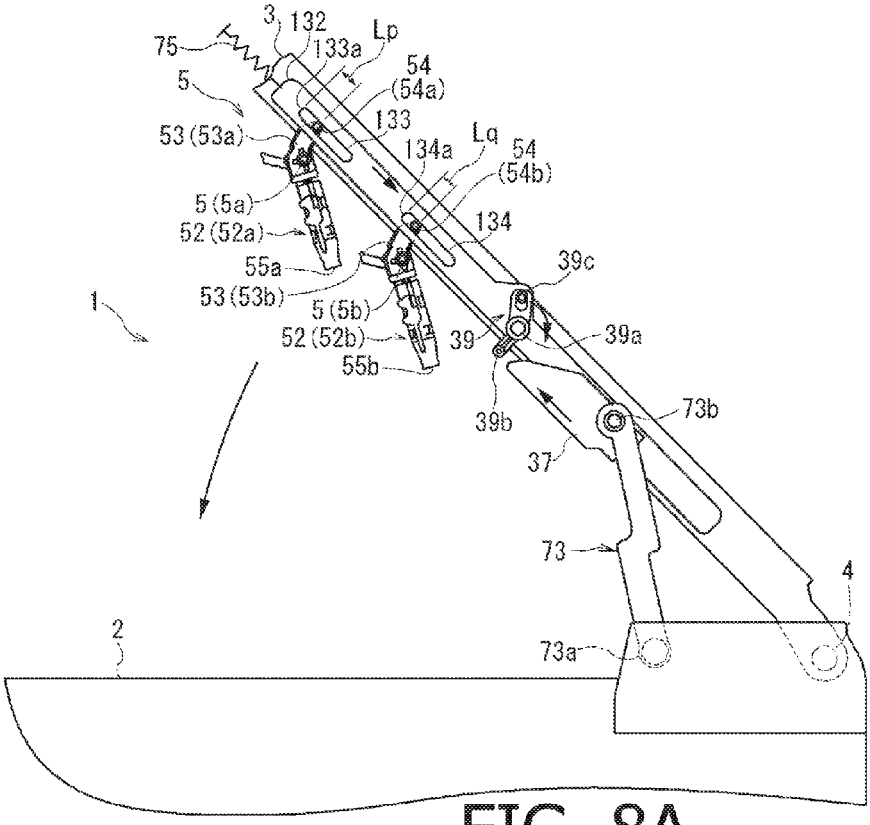
Figure 8B:
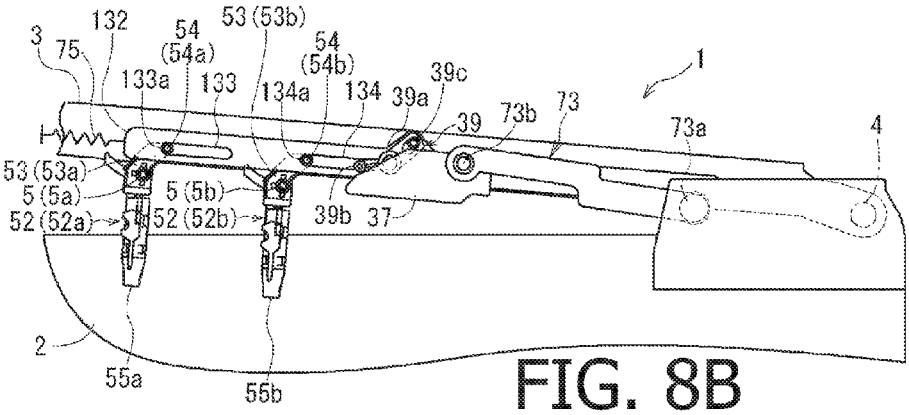

FIGS. 8A-8B are sideward views of a movable mechanism for the LED arrays in the image forming apparatus according to a third embodiment of the present disclosure.

Figure 9A:
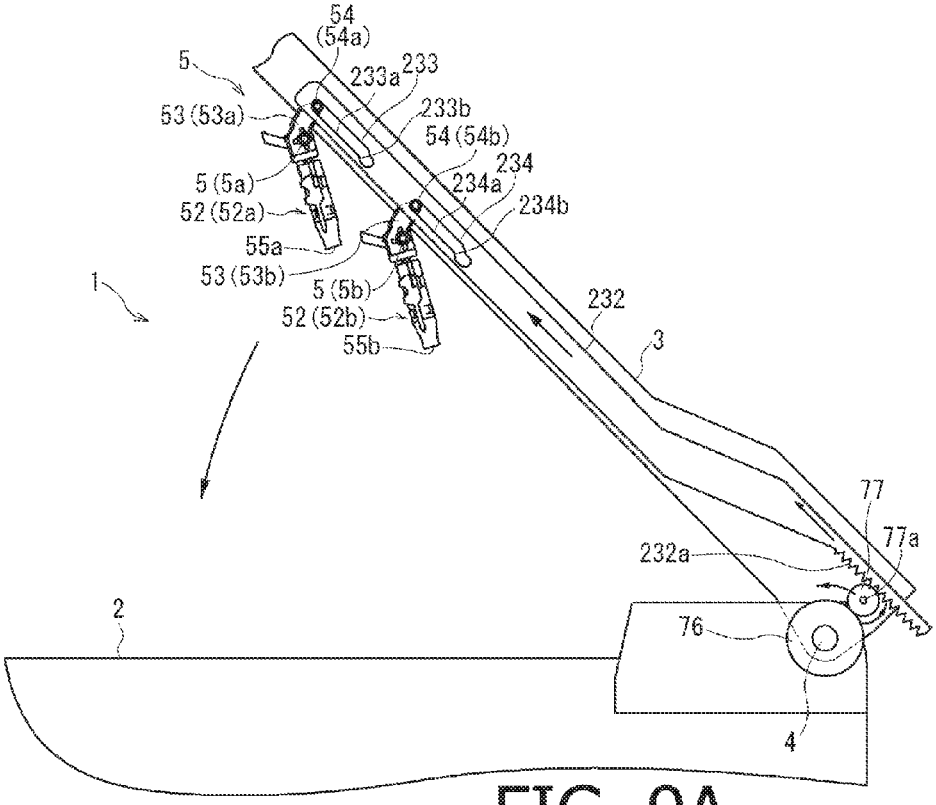
Figure 9B:
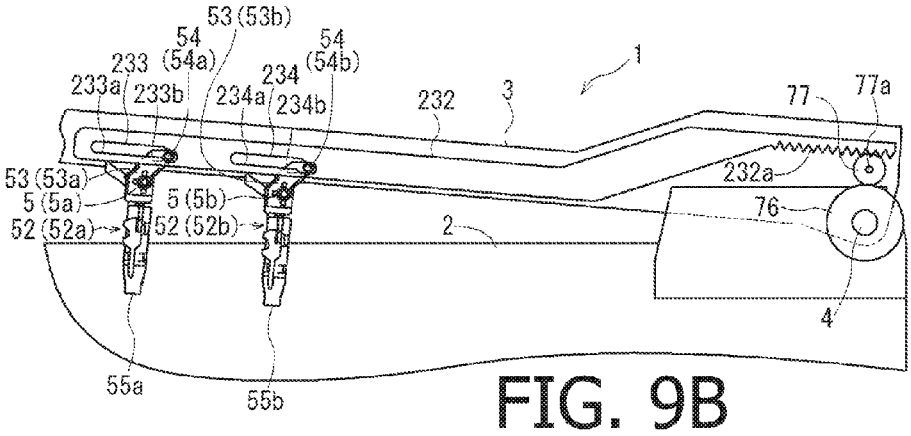

FIGS. 9A-9B are sideward views of a movable mechanism for the LED arrays in the image forming apparatus according to a fourth embodiment of the present disclosure.

DETAILED DESCRIPTION

Hereinafter, embodiments of the present disclosure will be described with reference to the accompanying drawings.

[Overall Configuration of Image Forming Apparatus]

Figure 1:
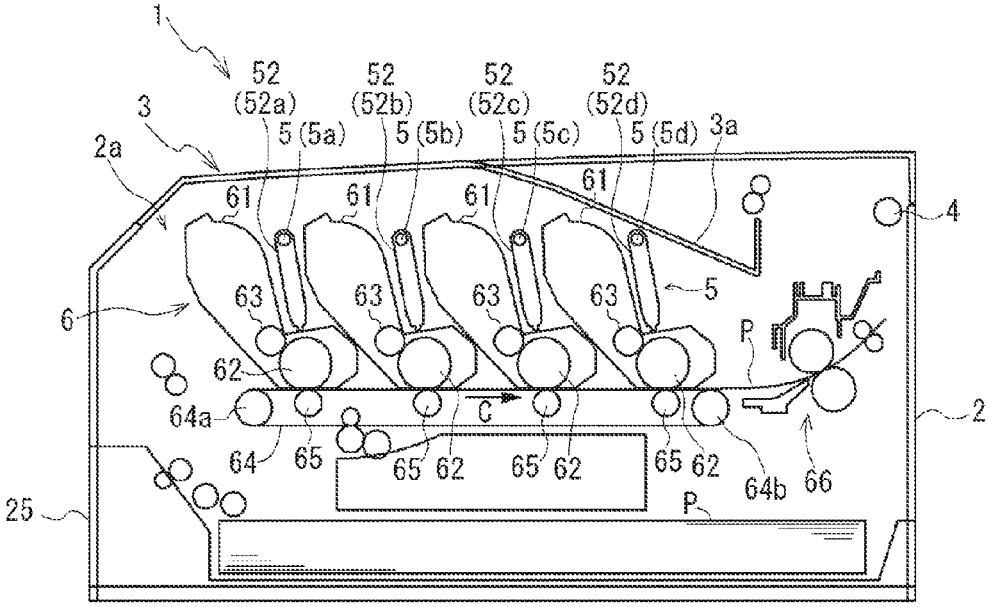
FIG. 1 is a cross-sectional view of an image forming apparatus according to a first embodiment of the present disclosure with a top cover being closed.

An image forming apparatus shown in FIG. 1 is a color laser printer, which may form an image in multiple colors on a sheet P, such as a sheet of paper or an OHP film, in an electro-photographic method.

In the following description, concerning orientation of the image forming apparatus 1, a viewer's left-hand side, a right-hand side, a nearer side, and a farther side in FIG. 1 will be referred to as a frontward side, a rearward side, a leftward side, and a rightward side of the image forming apparatus 1, respectively. An up-to-down and a down-to-up directions in FIG. 1 may be referred to as a vertical direction, right-to-left and left-to-right directions of the image forming apparatus 1 may be referred to as a widthwise direction, and front-to-rear and rear-to-front directions may be referred to as a direction of depth.

Figure 2:
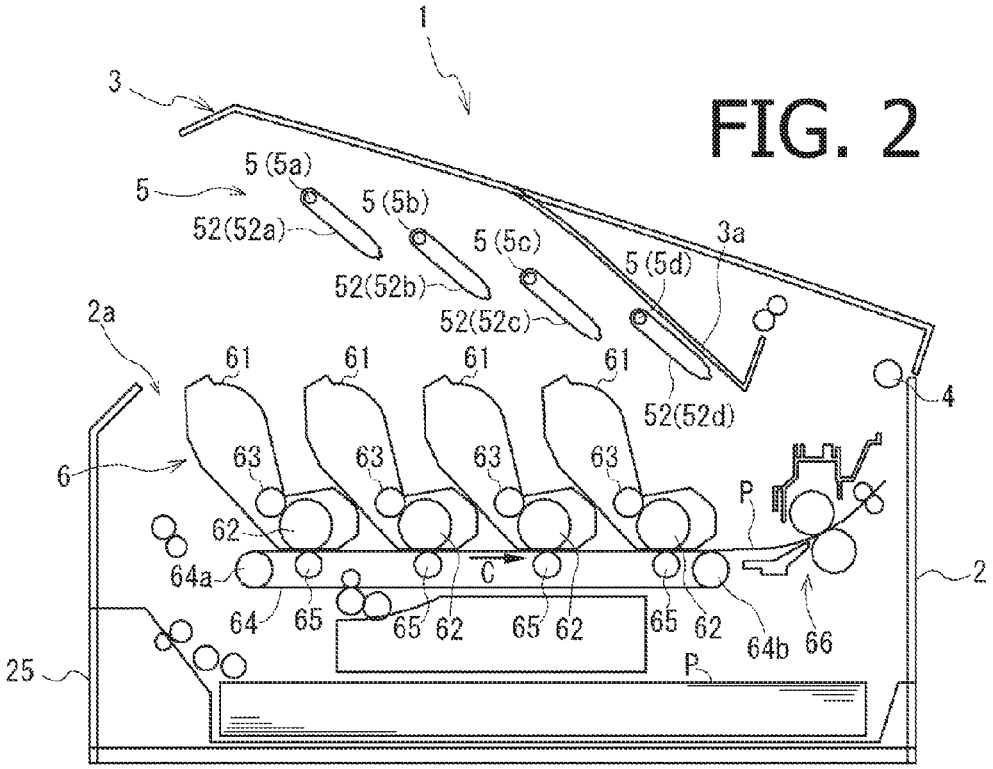
FIG. 2 is a cross-sectional view of the image forming apparatus according to the first embodiment of the present disclosure with the top cover being open.

The image forming apparatus 1 includes, as shown in FIGS. 1 and 2, a main body 2 and a top cover 3. The main body 2 includes an opening portion 2*a* formed on an upper side thereof. The top cover 3 is supported by the main body 2 pivotably at a rearward end portion thereof to pivot about a first pivot axis 4 so that a frontward end portion of the top cover 3 may swing upward or downward about the first pivot axis 4. The top cover 3 is movable to pivot between a first position, in which the top cover 3 covers the opening portion 2*a*, and a second position, in which the top cover 3 uncovers the opening portion 2*a*. FIG. 1 shows the image forming apparatus 1 with the top cover 3 being in the first position, and FIG. 2 shows the image forming apparatus 1 with the top cover 3 being in the second position.

In a room enclosed by the main body 2 and the top cover 3 in the image forming apparatus 1, accommodated is an image forming unit to form images on the sheet P. The image forming unit may be in an electro-photographic style and include a photosensitive unit 6 and an exposure unit 5.

The photosensitive unit 6 is accommodated in the main body 2 and includes a plurality of, e.g., four (4), drum units 61, which are arranged in line along the front-rear direction. The drum units 6 are for forming images in different colors, e.g., black, yellow, magenta, and cyan, and may be arranged in an order from upstream to downstream along a conveying direction C to convey the sheet P. The drum units 61 are attachable to and detachable from the main body 2 through the opening portion 2*a* while the top cover 3 is at the second position to expose the opening portion 2*a* in the main body 2.

Each of the drum unit 61 includes a photosensitive drum 62 and a developer roller 63. While the photosensitive drum 62 rotates, a surface of the photosensitive drum 62 may be electrically charged by a charger, which is not shown, evenly.

Meanwhile, a plurality of, e.g., four (4), LED arrays 52 are attached to the top cover 3. Each LED array 52 includes a plurality of LED elements, which align in line along an axial direction of the first pivot axis 4. The LED arrays 52 are each provided to one of the drum units 61 and arranged to align along the front-rear direction.

The LED arrays 52 are supported by the top cover 3 at basal ends thereof, which are upper ends in FIG. 1, pivotably to pivot about pivot axes 5 extending in parallel with the first pivot axis 4. Each LED array 52 is movable between an exposing position, at which a tip end portion being at a lower end in FIG. 1 opposite to the upper end is separated farther from the top cover 3, and a retracted position, at which the tip end portion is closer to the top cover 3.

The LED arrays 52 include a first LED array 52*a*, which is at a most upstream position along the conveying direction C; a second LED array 52*b*, which is at a downstream position from the first LED array 52*a* along the direction C; a third LED array 52*c*, which is at a downstream position from the second LED array 52*b* along the direction C; and a fourth LED array 52*d*, which is at a downstream positon from the third LED array 52*c* along the direction C.

The first LED 52*a* is supported by the top cover 3 at the basal end portion thereof pivotably to pivot about a second pivot axis 5*a*, which extends in parallel with the first pivot axis 4. The second LED array 52*b* is located closer to the first pivot axis 4 than the first LED array 52*a* and is supported by the top cover 3 at the basal end portion thereof pivotably to pivot about a third pivot axis 5*b*, which extends in parallel with the first pivot axis 4. The third LED array 52*c* is located closer to the first pivot axis 4 than the second LED array 52*b* and is supported by the top cover 3 at the basal end portion thereof pivotably to pivot about a fourth pivot axis 5*c*, which extends in parallel with the first pivot axis 4. The fourth LED array 52*d* is located closer to the first pivot axis 4 than the third LED array 52*c* and is supported by the top cover 3 at the basal end portion thereof pivotably to pivot about a fifth pivot axis 5*d*, which extends in parallel with the first pivot axis 4.

The first LED array 52*a*, the second LED array 52*b*, the third LED array 52*c*, and the fourth LED array 52*d* are different from one another in their positions with regard to the front-rear direction and in timings to move from the retracted positions to the exposing positions as the top cover 3 moves from the second position to the first position. Other than these, the first through fourth LED arrays 52*a*-52*d* are in a same form with one another. Therefore, in the following description, unless otherwise needed, the first through fourth LED arrays 52*a*, 52*b*, 52*c*, 52*d* may be collectively referred to as "the LED arrays 52" or represented by a term "LED array 52."

As shown in FIG. 1, when the top cover 3 is at the first position to cover the opening portion 2*a*, the LED arrays 52 are in the exposing positions, where the tip ends of the LED arrays 52 are farther from the top cover 3 and closer to the photosensitive drums 62 stored in the main body 2. Meanwhile, when the top cover 3 is in the second position to expose the opening portion 2*a*, as shown in FIG. 2, the LED arrays 52 are in the retracted positions to be closer to the top cover 3 to retract from the main body 2.

The photosensitive drums 62 that are evenly charged by the chargers may be selectively exposed to light from the LED arrays 52 so that charges in the selectively exposed regions are removed, and electrostatic latent images may be formed on surfaces of the photosensitive drums 62.

Meanwhile, the developer rollers 63, to which developer bias has been applied, carry toner on surfaces thereof and roll to face the electrostatic latent images on the photosensitive drums. Due to electric potential difference between the developer rollers 63 and the electrostatic latent images, the toner is supplied from the developer rollers 63 to the electrostatic latent images. Thereby, toner images are formed on the surfaces of the photosensitive drums 62.

The image forming apparatus 1 includes a sheet feeder cassette 25 to store sheets P at a lower position in the main body 2. The sheets P may be conveyed one by one to a surface of a conveyer belt 64 by rollers, which may be shown but are not signed. The conveyer belt 64 is strained around a pair of a driving roller 64*a* and a driven roller 64*b* at a lower position with respect to the photosensitive drums 62 to face the photosensitive drums 62. At positions coincident with the photosensitive drums 62 across the conveyer belt 64, arranged are transfer rollers 65.

The sheet P conveyed to the surface of the conveyer belt 64 is conveyed by the conveyer belt 64, which is driven by the driving roller 64*a* to circulate, to travel in the conveying direction C between the conveyer belt 64 and the photosensitive drums 64. Meanwhile, as the sheet P travels through the positions between the photosensitive drums 62 and the transfer rollers 65, the toner images formed on the surfaces of the photosensitive drums 62 are transferred onto the sheet P by transfer bias applied to the transfer rollers 65.

The sheet P with the toner images transferred thereon is conveyed to a fuser unit 66, which is located at a position downstream from the conveyer belt 64 along the conveying direction C. The fuser unit 66 applies heat and pressure to the sheet P so that the transferred toner images may be fused and fixed thereon. The sheet P with the fixed toner images is further conveyed by unsigned rollers and ejected outside the main body 2 to settle on an ejection tray 3*a*, which is formed in the top cover 3.

[First Embodiment of Pivotable Configuration for the LED Array]

As mentioned above, in the image forming apparatus 1, the LED arrays 52 are movable to pivot about the pivot axes 5, which extend in parallel with the first pivot axis 4, to move between the exposing positions and the retracted positions. In the following paragraphs, described will be a first embodiment of a pivoting configuration for the LED arrays 52.

Figure 3:
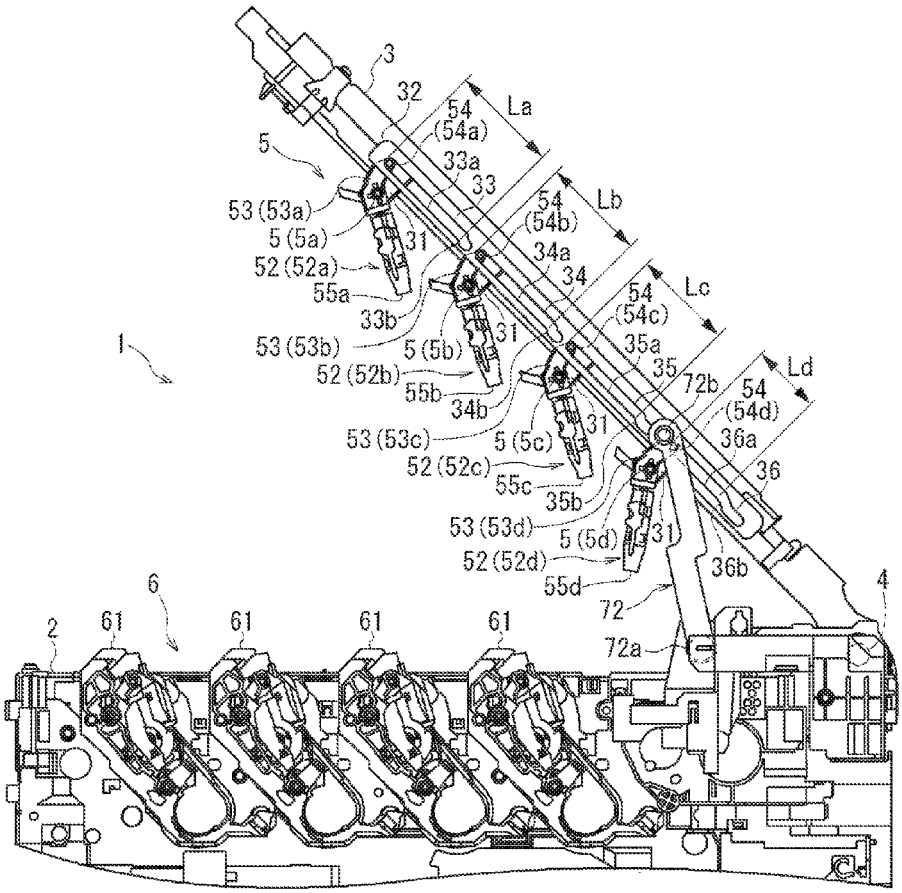
FIG. 3 is a cross-sectional sideward view of the image forming apparatus according to the first embodiment of the present disclosure with the top cover located at a second position and first through fourth LED arrays retained at retracted positions.

As shown in FIG. 3, the top cover 3 includes guide frames 31, which are formed to protrude toward the main body 2. A quantity of the guide frames 31 is equal to the quantity of the LED arrays 52. Each of the LED arrays 52 is pivotably supported by a corresponding one of the guide frames 31 to pivot about the pivot axis 5.

Specifically, the first LED array 52*a* is supported by the guide frame 31 pivotably to pivot about a second pivot axis 5*a*, the second LED array 52*b* is supported by the guide frame 31 pivotably to pivot about a third pivot axis 5*b*, the third LED array 52*c* is supported by the guide frame 31 pivotably to pivot about a fourth pivot axis 5*c*, and the fourth LED array 52*d* is supported by the guide frame 31 pivotably to pivot about a fifth pivot axis 5*d*.

Each LED array 52 includes an arm 53 at the basal portion thereof. The arm 53 extends in a direction orthogonal to the pivot axis 5 from a portion of the LED array 52, where the pivot axis 5 is located, to the top cover 3. At a tip end being an upper end of the arm 53, formed is an engagement pin 54, which extends along the axial direction of the pivot axes 5*a*-5*d*.

Specifically, the first LED array 52*a* includes an arm 53*a* and an engagement pin 54*a*, the second LED array 52*b* includes an arm 53*b* and an engagement pin 54*b*, the third LED array 52*c* includes an arm 53*c* and an engagement pin 54*c*, and the fourth LED array 52*d* includes an arm 53*d* and an engagement pin 54*d*.

Meanwhile, the top cover 3 includes a linear-motion plate 32, which is movably supported by the top cover 3 to move in a direction orthogonal to the first pivot axis 4 and along the front-rear direction. In a position between the top cover 3 and the main body 2, arranged is an arm 72, which includes a body-side end portion 72*a* and a cover-side end portion 72*b*. The arm 72 is supported pivotably by the main body 2 at the body-side end portion 72*a* and by the linear-motion plate 32 at the cover-side end portion 72*b*, which is on a longitudinal end of the arm 72 opposite to the body-side end portion 72*a*. The linear-motion plate 32 and the arm 72 may be arranged on either rightward or leftward side of the image forming apparatus 1.

The linear-motion plate 32 is movable in the direction orthogonal to the first pivot axis 4 in conjunction with the top cover 3 moving between the first position and the second position. For example, the linear-motion plate 32 may move frontward as the top cover 3 moves from the second position toward the first position and may move rearward as the top cover 3 moves from the first position toward the second position.

The linear-motion plate 32 is formed to have cam holes 33, 34, 35, 36, which are elongated along the movable direction of the linear-motion plate 32. The cam holes 33, 34, 35, 36 are arranged in the order being cited above along a direction from the front side toward the rear side. In other words, the cam hole 33 is at a position closest to the front; the cam holes 34 35 are at positions second closest and third closest from the front, respectively; and the cam hole 36 is at a positon farthest from the front. The cam hole 33 is slidably engaged with the engagement pin 54*a* of the first LED array 52*a*, the cam hole 34 is slidably engaged with the engagement pin 54*b* of the second LED array 52*b*, the cam hole 35 is slidably engaged with the engagement pin 54*c* of the third LED array 52*c*, and the cam hole 36 is slidably engaged with the engagement pin 54*d* of the fourth LED array 52*d*.

The cam hole 33 includes a retainer cam edge 33*a* and a pivoting cam edge 33*b*. The retainer cam edge 33*a* extends along the movable direction of the linear-motion plate 32. The pivoting cam edge 33*b* is formed at a rearward position continuously from the retainer cam edge 33 and inclines rearward with respect to the retainer cam edge 33 to be closer toward the main body 2. While the engagement pin 54*a* is engaged with the cam hole 33 at the retainer cam edge 33*a*, the first LED array 52*a* is maintained at the retracted position. On the other hand, when the engagement pin 54*a* is engaged with the cam hole 33 at the pivoting cam edge 33*b*, the first LED array 52*a* is pivoted about the second pivot axis 5*a* by the pivoting cam edge 33*b* to the exposing position.

The cam hole 34 includes a retainer cam edge 34*a* and a pivoting cam edge 34*b*, which may serve similarly to the retainer cam edge 33*a* and the pivoting cam edge 33*a* in the cam hole 33. While the engagement pin 54*b* is engaged with the cam hole 34 at the retainer cam edge 34*a*, the second LED array 52*b* is maintained at the retracted position. On the other hand, when the engagement pin 54*b* is engaged with the cam hole 34 at the pivoting cam edge 34*b*, the second LED array 52*b* is pivoted about the third pivot axis 5*b* by the pivoting cam edge 34*b* to the exposing position.

The cam hole 35 includes a retainer cam edge 35*a* and a pivoting cam edge 35*b*, which may serve similarly to the retainer cam edge 33*a* and the pivoting cam edge 33*a* in the cam hole 33. While the engagement pin 54*c* is engaged with the cam hole 35 at the retainer cam edge 35*a*, the third LED array 52*c* is maintained at the retracted position. On the other hand, when the engagement pin 54*c* is engaged with the cam hole 35 at the pivoting cam edge 35*b*, the third LED array 52*c* is pivoted about the fourth pivot axis 5*c* by the pivoting cam edge 35*b* to the exposing position.

The cam hole 36 includes a retainer cam edge 36*a* and a pivoting cam edge 36*b*, which may serve similarly to the retainer cam edge 33*a* and the pivoting cam edge 33*a* in the cam hole 33. While the engagement pin 54*d* is engaged with the cam hole 36 at the retainer cam edge 36*a*, the fourth LED array 52*d* is maintained at the retracted position. On the other hand, when the engagement pin 54*d* is engaged with the cam hole 36 at the pivoting cam edge 36*b*, the fourth LED array 52*d* is pivoted about the fifth pivot axis 5*d* by the pivoting cam edge 36*b* to the exposing position.

A dimension between a front end of the cam hole 33 and the pivoting cam edge 33*b*, i.e., a length La of the retainer cam edge 33*a* in the cam hole 33, is greater than a length Lb of the retainer cam edge 34*a* in the cam hole 34. The length Lb of the retainer cam edge 34*a* is greater than a length Lc of the retainer cam edge 35*a* in the cam hole 35. The length Lc of the retainer cam edge 35*a* is greater than a length Ld of the retainer cam edge 36*a* in the cam hole 36. (I.e., La>Lb>Lc>Ld.)

When the top cover 3 is in the second position, as shown in FIG. 3, the engagement pins 54*a*, 54*b*, 54*c*, 54*d* are located at positions in frontward end portions in the cam holes 33, 34, 35, 36, respectively. As the top cover 3 moves from the second position toward the first position, the linear-motion plate 32 moves frontward; therefore, the engagement pins 54*a*, 54*b*, 54*c*, 54*d* relatively move rearward in the cam holes 33, 34, 35, 36, respectively.

As the engagement pins 54*a*, 54*b*, 54*c*, 54*d* relatively move rearward within the cam holes 33, 34, 35, 36, the LED arrays 52 stay at the retracted positions, respectively, as long as the engagement pins 54*a*, 54*b*, 54*c*, 54*d* are engaged with the retainer cam edges 33*a*, 34*a*, 35*a*, 36*a*. Once the engagement pins 54*a*, 54*b*, 54*c*, 54*d* move to pivoting cam edges 33*b*, 34*b*, 35*b*, 36*b*, the first through fourth LED arrays 52*a*, 52*b*, 52*c*, 2*d* are moved to pivot about the second pivot axis 5*a*, the third pivot axis 5*b*, the fourth pivot axis 5*c*, the fifth pivot axis 5*d*, respectively, to the exposing positions.

While the lengths La, Lb, Lc, Ld of the cam holes 33, 34, 35, 36 are greater in the cited order (La>Lb>Lc>Ld), when the top cover 3 moves toward the first position, among the engagement pins 54*a*, 54*b*, 54*c*, 54*d*, the engagement pin 54*d* reaches the position of the pivoting cam edge 36*b* earliest. Thereafter, the engagement pins 54*c*, 54*b*, 54*a* reach the positions of the pivoting cam edges 35*b*, 34*b*, 33*b*, secondly, thirdly, and fourthly, respectively.

Therefore, when the top cover 3 is in the second position, as shown in FIG. 3, the LED arrays 52 are retained at the retracted positions. As the top cover 2 moves from the second position toward the first position, the engagement pins 54*a*, 54*b*, 54*c*, 54*d* move rearward within the cam holes 33, 34, 35, 36, respectively, and among the engagement pins 54*a*, 54*b*, 54*c*, 54*d*, the engagement pin 54*d* firstly reaches the position of the pivoting cam edge 36*b*. As the engagement pin 54*d* reaches the position of the pivoting cam edge 36*b*, as shown in FIG. 4B, the fourth LED array 54*d* is moved to pivot from the retracted position to the exposing position.

As the top cover 3 further moves from the position shown in FIG. 4A toward the first position, the engagement pin 54*c* secondly reaches the position of the pivoting cam edge 35*b* and, as shown in FIG. 4B, the third LED array 52*c* is moved to pivot from the retracted position to the exposing position. As the top cover 3 further moves from the position shown in FIG. 4B toward the first position, the engagement pin 54*b* thirdly reaches the position of the pivoting cam edge 34*b* and, as shown in FIG. 5A, the second LED array 52*b* is moved to pivot from the retracted position to the exposing position. As the top cover 3 further moves from the position shown in FIG. 5A toward the first position, the engagement pin 54*a* fourthly reaches the position of the pivoting cam edge 33*b* and, as shown in FIG. 5B, the first LED array 52*a* is moved to pivot from the retracted position to the exposing position.

Thus, in the image forming apparatus 1, while the linear-motion plate 32 moves in conjunction with the top cover 3 moving from the second position to the first position, the engagement pins 54*a*, 54*b*, 54*c*, 54*d* move to engage with the pivoting cam edges 33*b*, 34*b*, 35*b*, 35*b*. Thereby, the LED arrays 52 are moved from the retracted positions to the exposing positions. In this regard, the pivoting cam edge 33*b* and the pivoting cam edge 34*b* are arranged to engage with the engagement pins 54*a*, 54*b*, respectively, at different timings. In particular, the pivoting cam edge 33*b* and the pivoting cam edge 34*b* are in an arrangement such that the timing, at which the pivoting cam edge 33*b* engages with the engagement pin 54*a*, is delayed to be later than the timing, at which the pivoting cam edge 34*b* engages with the engagement pin 54*b*. Therefore, the first LED array 52*a* is moved from the retracted position to the exposing position at the delayed timing later than the second LED array 52*b*.

Further, the pivoting cam edge 34*b* and the pivoting cam edge 35*b* are arranged to engage with the engagement pins 54*b*, 54*c*, respectively, at different timings. In particular, the pivoting cam edge 34*b* and the pivoting cam edge 35*b* are in an arrangement such that the timing, at which the pivoting cam edge 34*b* engages with the engagement pin 54*b*, is delayed to be later than the timing, at which the pivoting cam edge 35*b* engages with the engagement pin 54*c*. Therefore, the second LED array 52*b* is moved from the retracted position to the exposing position at the delayed timing later than the third LED array 52*c*. Furthermore, the pivoting cam edge 35*b* and the pivoting cam edge 36*b* are arranged to engage with the engagement pins 54*c*, 54*d*, respectively, at different timings. In particular, the pivoting cam edge 35*b* and the pivoting cam edge 36*b* are in an arrangement such that the timing, at which the pivoting cam edge 35*b* engages with the engagement pin 54*c*, is delayed to be later than the timing, at which the pivoting cam edge 36*b* engages with the engagement pin 54*d*. Therefore, the third LED array 52*c* is moved from the retracted position to the exposing position at the delayed timing later than the fourth LED array 52*d*.

Thus, the arm 72, the linear-motion plate 32 with the cam holes 33, 34, 35, 36, and the engagement pins 54*a*, 54*b*, 54*c*, 54*d* form a linkage mechanism that may move the first through fourth LED arrays 52*a*, 52*b*, 52*c*, 52*d* to pivot between the exposing positions and the retracted positions. The linkage mechanism including the arm 72, the linear-motion plate 32 with the cam holes 33, 34, 35, 36, and the engagement pins 54*a*, 54*b*, 54*c*, 54*d*, is linked with the first through fourth LED arrays 52*a*, 52*b*, 52*c*, 52*d*.

Thereby, when the top cover 3 moves from the second position to the first position, the first LED array 52*a*, for example, which is at the position closer to a user than the second through forth LED arrays 52*b*, 52*c*, 52*d*, may move from the retracted position to the exposing position at the timing later than the second through forth LED arrays 52*b*, 52*c*, 52*d*. Therefore, the first LED array 52*a*, which is closer to a user and may be more likely to be touched or tainted by the user than the second through forth LED arrays 52*b*, 52*c*, 52*d*, may start moving toward the exposing position at a delayed timing later than timings, at which the second through forth LED arrays 52*b*, 52*c*, 52*d* start moving toward the exposing positions, so that the first LED array 52*a* may be restrained from being tainted.

The first through fourth LED arrays 52*a*, 52*b*, 52*c*, 52*d* have exposure surfaces 55*a*, 55*b*, 55*c*, 55*d*, respectively, at the tip ends thereof. The linkage mechanism including the arm 72, the linear-motion plate 32 with the cam holes 33, 34, 35, 36, and the engagement pins 54*a*, 54*b*, 54*c*, 54*d*, direct the tip ends of the LED arrays 52 to be closer to the first pivot axis 4 when the LED arrays 52 are moved from the exposing positions to the retracted positions. Meanwhile, the linear-motion plate 32 is moved rearward by the arm 72, and the LED arrays 52 are moved from the exposing positions to the retracted positions in a sequence reversed from the sequence where the top cover 3 moves from the second position to the first position.

Thus, as the LED arrays 52 are moved from the exposing positions to the retracted positions, the tip ends with the exposure surfaces 55*a*, 55*b*, 55*c*, 55*d* are directed toward the first pivot axis 4 so that the tip ends may be farther from the user, and the exposure surfaces 55*a*, 55*b*, 55*c*, 55*d* may be restrained from being tainted more effectively.

It may be noted that the cam holes 33, 34, 35, 36 in the linear-motion plate 32 may not necessarily be formed in the elongated round shape to engage with the engagement pins 54*a*, 54*b*, 54*c*, 54*d*, but may be in another shape as long as the engagement pins 54*a*, 54*b*, 54*c*, 54*d* are engageable with the retainer cam edges 33, 34, 35, 36 and with the pivoting cam edges 33*b*, 34*b*, 35*b*, 36*b*, respectively (see, for example, FIG. 6).

[Second Embodiment of Pivotable Configuration for the LED Arrays]

A second embodiment of the pivotable configuration for the LED arrays 52 will be described below. In the following description, items or structures which are the same as or similar to the items or the structure described in the previous embodiment will be referred to by the same reference signs, and description of those will be omitted.

As described in the first embodiment described above, the linear-motion cam 32 may be moved directly by the arm 72 as the top cover 3 moves between the first position and the second position. In this regard, as shown in FIGS. 7A-7B, the linear-motion plate 32 may be moved through a slider member 37 and a link lever 38. In FIGS. 7A-7B, it may be noted that illustration of the third and fourth LED arrays 52*c*, 52*d*, the cam holes 35, 36, and the engagement pins 54*c*, 54*d* is omitted.

As shown in FIGS. 7A-7B, the pivotable configuration for the LED arrays 52*a*, 52*b*, 52*c*, 52*d* includes the linear-motion plate 37, the slider member 37, the link lever 38, an arm 73, and a spring 74.

The slider member 37 is supported by the top cover 3 slidably to slide with respect to the top cover 3 in the direction orthogonal to the axial direction of the first pivot axis 4 and along the front-rear direction. In a position between the top cover 3 and the main body 2, arranged is the arm 73, which includes a body-side end portion 73*a* and a cover-side end portion 73*b*. The arm 73 is supported pivotably by the main body 2 at the body-side end portion 73*a* and by the slider member 37 at the cover-side end portion 73*b*, which is on a longitudinal end of the arm 72 opposite to the body-side end portion 73*a*.

The slider member 37 is movable in the direction orthogonal to the first pivot axis 4 in conjunction with the top cover 3 moving between the first position and the second position. For example, the slider member 37 may move frontward as the top cover 3 moves from the second position toward the first position and may move rearward as the top cover 3 moves from the first position toward the second position.

The link lever 38 is supported pivotably by the top cover 3 at a frontward position with respect to the slider member 37 to pivot about a pivot axis 38*a*, which extends in parallel with the first pivot axis 4. The link lever 38 includes a contact portion 38*b*, which may contact the slider member 37, and a coupling portion 38*c*, which is coupled with the linear-motion plate 32. The pivot axis 38*a*, the coupling portion 38, and the contact portion 38*b* are arranged in an upper position, a midst position, and a lower position, respectively, within the link lever 38.

The linear-motion plate 32 is urged by the spring 74, which is arranged between a rearward end of the linear-motion plate 32 and the top cover 3. The linear-motion plate 32 in the second embodiment may be similar to the linear-motion plate 32 in the first embodiment except that the linear-motion plate 32 in the second embodiment is not connected with the cover-side end portion 72*b* of the arm 72 but the linear-motion plate 32 in the second embodiment is coupled with the coupling portion 38*c* of the link lever 38.

While the top cover 3 is in the second position, as shown in FIG. 7A, the linear-motion plate 32 is located rearward due to an urging force of the spring 74, and the slider member 37 is located rearward and separated from the contact portion 38*b*. Meanwhile, the engagement pins 54*a*, 54*b*, 54*c*, 54*d* are located at frontward positions in the cam holes 33, 34, 35, 36, respectively.

As the top cover 3 moves from the second position toward the first position, the slider member 37 moves frontward to contact the contact portion 38*b*. The slider member 37 contacting the contact portion 38*b* may move further frontward so that the contact portion 38*b* may move frontward. Thereby, the link lever 38 may be moved to pivot about the pivot axis 38*a*. As the link lever 38 pivots, the coupling portion 38*c* and the linear-motion plate 32 coupled with the coupling portion 38*c* move frontward.

As the linear-motion plate 32 moves frontward, the engagement pin 54*d* first reaches the position of the pivoting cam edge 36*b*, where the fourth LED array 52*d* is pivoted to move from the retracted position to the exposing position. Secondly, the engagement pin 54*c* reaches the position of the pivoting cam edge 35*b*, where the third LED array 52*c* is pivoted to move from the retracted position to the exposing position. Thirdly, the engagement pin 54*b* reaches the position of the pivoting cam edge 34*b*, where the second LED array 52*b* is pivoted to move from the retracted position to the exposing position. Finally, the engagement pin 54*a* reaches the position of the pivoting cam edge 33*b*, where the first LED array 52*a* is pivoted to move from the retracted position to the exposing position, as shown in FIG. 7B.

[Third Embodiment of Pivotable Configuration for the LED Arrays]

A third embodiment of the pivotable configuration for the LED arrays 52*a*, 52*b*, 52*c*, 52*d* with a linear-motion plate 132 will be described below with reference to FIGS. 8A-8B. In the following description, items or structures which are the same as or similar to the items or the structure described in the previous embodiment will be referred to by the same reference signs, and description of those will be omitted.

The linear-motion plate 132 in the third embodiment may move in conjunction with the slider member 37 and a link lever 39 to move the LED arrays 52 between the retracted positions and the exposing positions. In FIGS. 8A-8B, it may be noted that illustration of the third and fourth LED arrays 52*c*, 52*d*, engageable holes 135, 136 with engageable portions 135*a*, 136*a* in the linear-motion plate 132, and the engagement pins 54*c*, 54*d* is omitted.

The pivotable configuration for the LED arrays 52 may include the linear-motion plate 132, the slider member 37, the link lever 39, the arm 73, and a spring 75.

The linear-motion plate 132 is supported movably by the top cover 3 to move in the direction orthogonal to the first pivot axis 4 and along the front-rear direction. The linear-motion plate 132 is formed to have engageable holes 133, 134, 135 (not shown), 136 (not shown), which are elongated along the movable direction of the linear-motion plate 132. The engageable holes 133, 134, 135, 136 are arranged in the order being cited along the direction from the front side toward the rear side. In other words, the engageable holes 133, 134, 135, 136 are at a position closest to the front, a position second closest to the front, a position third closest to the front, and a positon farthest from the front, respectively. The engageable hole 133 is slidably engaged with the engagement pin 54*a* of the first LED array 52*a*, the engageable hole 134 is slidably engaged with the engagement pin 54*b* of the second LED array 52*b*, the engageable hole 135 is slidably engaged with the engagement pin 54*c* (not shown) of the third LED array 52*c*, and the engageable hole 136 is slidably engaged with the engagement pin 54*d* of the fourth LED array 52*d*.

The engageable hole 133 includes an engageable portion 133*a*, with which the engagement pin 54*a* is engageable, at a frontend position thereof. The engageable hole 134 includes an engageable portion 134*a*, with which the engagement pin 54*b* is engageable, at a frontend position thereof. The engageable hole 135 includes an engageable portion 135*a* (not shown), with which the engagement pin 54*c* is engageable, at a frontend position thereof. The engageable hole 136 includes an engageable portion 136*a* (not shown), with which the engagement pin 54*d* is engageable, at a frontend position thereof.

The link lever 39 is supported pivotably by the top cover 3 at a frontward position with respect to the slider member 37 to pivot about a pivot axis 39*a*, which extends in parallel with the first pivot axis 4. The link lever 39 includes a contact portion 39*b*, which may contact the slider member 37, and a coupling portion 39*c*, which is coupled with a linear-motion plate 132. The coupling portion 39*c*, the pivot axis 39*a*, and the contact portion 39*b* are arranged in an upper position, a midst position, and a lower position, respectively, within the link lever 39.

The linear-motion plate 132 is urged frontward by the spring 75, which is arranged between a frontward end of the linear-motion plate 132 and the top cover 3.

While the top cover 3 is in the second position, as shown in FIG. 8A, the linear-motion plate 132 is located frontward due to an urging force of the spring 75. Meanwhile, the engagement pins 54*a*, 54*b*, 54*c*, 54*d* are located at rearward positions within the engageable holes 133, 134, 135, 136, respectively. In this arrangement, the LED arrays 52 are retained at the retracted positions.

In this condition, a distance Lp between the engageable portion 133*a* in the engageable hole 133 and the engagement pin 54*a* is greater than a distance Lq between the engageable portion 134*a* in the engageable hole 134 and the engagement pin 54*b*. The distance Lq is greater than a distance Lr (not shown) between the engageable portion 135*a* in the engageable hole 135 and the engagement pin 54*c*. The distance Lr is greater than a distance Ls (not shown) between the engageable portion 136*a* in the engageable hole 136 and the engagement pin 54*d*. (I.e., Lp>Lq>Lr>Ls.)

As the top cover 3 moves from the second position toward the first position, the slider member 37 is moved frontward by the arm 73 to contact the contact portion 39*b*. The slider member 37 contacting the contact portion 39*b* may be moved further frontward so that the contact portion 39*b* may move frontward. Thereby, the link lever 39 may pivot about the pivot axis 39*a*. As the link lever 39 pivots, the coupling portion 39*c* and the linear-motion plate 132 coupled with the coupling portion 38*c* move rearward.

As the linear-motion plate 132 moves rearward, engageable portion 136*a* first contacts the engagement pin 54*d*, where the fourth LED array 52*d* is pivoted to move from the retracted position to the exposing position. Secondly, the engageable portion 135*a* contacts the engagement pin Mc, where the third LED array 52*c* is pivoted to move from the retracted position to the exposing position. Thirdly, the engageable portion 134*a* contacts the engagement pin 54*b*, where the second LED array 52*b* is pivoted to move from the retracted position to the exposing position. Finally, the engageable portion 133*a* contacts the engagement pin 43*a*, where the first LED array 52*a* is pivoted to move from the retracted position to the exposing position.

[Fourth Embodiment of Pivotable Configuration for the LED Arrays]

A fourth embodiment of the pivotable configuration for the LED arrays 52 with a linear-motion plate 232 will be described below with reference to FIGS. 9A-9B. In the following description, items or structures which are the same as or similar to the items or the structure described in the previous embodiment will be referred to by the same reference signs, and description of those will be omitted.

The linear-motion plate 232 may move in conjunction with a first gear 76 and a second gear 77 to move the LED arrays 52 between the retracted positions and the exposing positions. In FIGS. 9A-9B, it may be noted that illustration of the third and fourth LED arrays 52*c*, 52*d*, cam holes 235, 236 in the linear-motion plate 132, and the engagement pins 54*c*, 54*d* is omitted.

The pivotable configuration for the LED arrays 52 may include the linear-motion plate 232, the first gear 76, and the second gear 77.

The first gear 76 is attached to the first pivot axis 4. A rotational position of the first gear 76 is fixed. In other words, the first gear 76 does not rotate. The second gear 77 is attached to the top cover 3 and meshes with the first gear 76. The second gear 77 is revolvable around the first pivot axis 4 and roratable about a rotation axis 77*a* along with the top cover 3 moving between the first position and the second position. In other words, the second gear 77 may revolve around the first pivot axis 4 and rotate about the rotation axis 77*a* while the top cover moves between the first position and the second position.

At a rearward position in the linear-motion plate 232, formed is a rack gear 232*a,* which meshes with the second gear 77. The linear-motion plate 232 in the fourth embodiment may be similar to the linear-motion plate 32 in the first embodiment except that the linear-motion plate 232 is not connected with the cover-side end portion 72*b* of the arm 72 but the rack gear 232*a* is formed therein. Further, the linear-motion plate 232 is formed to have cam holes 233, 234, 235, 236, which include retainer cam edges 233*a,* 234*a,* 235*a,* 236*a,* respectively, and pivoting cam edges 233*b,* 234*b,* 235*b,* 236*b,* respectively.

While the top cover 3 is in the second position, as shown in FIG. 9A, the linear-motion plate 232 is located rearward, and, the engagement pins 54*a,* 54*b,* 54*c,* 54*d* are located at frontward positions within the cam holes 233, 234, 235, 236, respectively.

As the top cover 3 moves from the second position toward the first position, the second gear 77 revolves around the first pivot axis 4 in conjunction with the movement of the top cover 3 in a first rotating direction, e.g., counterclockwise in FIG. 9A.

Along with the revolving movement, the second gear 77, which is meshed with the first gear 76 being fixed not to rotate, rotates about the rotation axis 77*a* in the first rotating direction. As the second gear 77 rotates in the first rotating direction, due to the engagement between the second gear 77 and the rack gear 232*a,* the linear-motion plate 232 moves frontward.

As the linear-motion plate 232 moves frontward, the engagement pin 54*d* first reaches the position of the pivoting cam edge 236*b,* where the fourth LED array 52*d* is pivoted to move from the retracted position to the exposing position. Secondly, the engagement pin 54*c* reaches the position of the pivoting cam edge 235*b,* where the third LED array 52*c* is pivoted to move from the retracted position to the exposing position. Thirdly, the engagement pin 54*b* reaches the position of the pivoting cam edge 234*b,* where the second LED array 52*b* is pivoted to move from the retracted position to the exposing position. Finally, the engagement pin 54*a* reaches the position of the pivoting cam edge 233*b,* where the first LED array 52*a* is pivoted to move from the retracted position to the exposing position, as shown in FIG. 9B.

[Benefits]

The image forming apparatus 1 to form images electrophotographically includes the main body 2 having the opening portion 2*a* at an upper side thereof; the top cover 3 including the rearward end portion and the rearward end portion opposite to the rearward end portion, the top cover 3 being supported by the main body 2 at the rearward end portion thereof pivotably about the first pivot axis 4, the top cover 3 being configured to move the frontward end portion between the first position, in which the top cover 3 covers the opening portion 2*a,* and the second position, in which the top cover 3 exposes the opening portion 2*a;* the first LED array 52*a* supported by the top cover 3 at the basal end portion thereof pivotably about the second pivot axis 5*a,* the second pivot axis 5*a* extending in parallel with the first pivot axis 4, the first LED array 52*a* being configured to move between the exposing position, in which the tip end portion of the first LED array 52*a* opposite to the basal end portion is separated farther from the top cover 3, and the retracted position, in which the tip end portion of the first LED array 52*a* is closer to the top cover 3; the second LED array 52*b* arranged at the position closer to the first pivot axis 5*a* than the first LED array 52*a,* the second LED array 52*b* being supported by the top cover 3 at the basal end portion thereof pivotably about the third pivot axis 5*b,* the third pivot axis 5*b* extending in parallel with the first pivot axis 4, the second LED array 52*b* being configured to move between the exposing position, in which the tip end portion of the second LED array 52*b* opposite to the basal end portion is separated farther from the top cover 3, and the retracted position, in which the tip end portion of the second LED array 52*b* is closer to the top cover 3; and the linkage mechanism linked with the first LED array 52*a* and with the second LED array 52*b,* the linkage mechanism being configured to move the second LED array 52*b* from the retracted position toward the exposing position and move the first LED array 52*a* from the retracted position toward the exposing position at a timing later than the second LED array 52*b* moving toward the exposing position in conjunction with the top cover 3 moving from the second position toward the first position.

According to the configuration described above, while the top cover 3 moves from the second position to the first position, one of the LED arrays 52, e.g., the first LED array 52*a,* which is at a position closer to the user, may move toward the exposing position at a timing later than the second LED array 52*b,* which is another one of the LED arrays 52 at a position farther from the user, moving toward the exposing position. Therefore, the first LED array 52*a,* which may be more likely to be touched or tainted by the user, may start moving toward the exposing position at the later timing than the second LED array 52*b,* so that the first LED array 52*a* may be prevented from being touched or tainted by the user.

Further, the image forming apparatus 1 may include the third LED array 52*c* arranged at the position closer to the first pivot axis 4 than the second LED array 52*b,* the third LED array 52*c* being supported by the top cover 3 at the basal end portion thereof pivotably about the fourth pivot axis 5*c,* the fourth pivot axis 5*c* extending in parallel with the first pivot axis 4, the third LED array 52*c* being configured to move between the exposing position, in which the tip end portion of the third LED array 52*c* opposite to the basal end portion is separated farther from the top cover 3, and the retracted position, in which the tip end portion of the third LED array 52*c* is closer to the top cover 3. The linkage mechanism may move the third LED array 52*c* from the retracted position toward the exposing position at a timing earlier than the second LED array 52*b* moving toward the exposing position in conjunction with the top cover 3 moving from the second position toward the first position.

While the top cover 3 is in the second position, a distance between one of the LED arrays 52, e.g., the third LED array 52*c,* being at a position closer to the first pivot axis 4 and the main body 4 is shorter than a distance between another one of the LED arrays 52, e.g., the second LED array 52*b,* being at a position farther from the first pivot axis 4 and the main body 2. In this regard, while the top cover 3 moves from the second position to the first position, the third LED array 52*c* being at the position closer to the first pivot axis 4 may start moving from the retracted position toward the exposing position at an earlier timing than the second LED array 52*b* being at the position farther from the first pivot axis 4. Therefore, among the first through fourth LED arrays 52*a,* 52*b,* 52*c,* 52*d,* the fourth LED array 52*d,* which is the closest to the first pivot axis 4, the third LED array 52*c,* which is the second closest to the first pivot axis 4, the second LED array 52*b,* which is the third closest to the first pivot axis 4, and the first LED array 52*a,* which is the farthest from the first pivot axis 4, start moving from the retracted positions toward the exposing positions in the order being mentioned so that the farther position the LED array 52 is located from the first pivot axis 4, the later the LED array 52 starts moving toward the exposing position. Thus, the LED arrays 52 closer to a user may be maintained clean without being tainted as they are moving from the retracted positions to the exposing positions.

Further, the LED arrays 52 may include the exposure surfaces 55*a*, 55*b*, 55*c*, 55*d* at the tip ends thereof. The linkage mechanism may be linked further with the third and fourth LED arrays 52*c*, 52*d* and may direct the tip ends of the first LED arrays 52 to be closer to the first pivot axis 4 in conjunction with the top cover 3 moving from the second position toward the first position to move the LED arrays 52 from the exposing positions toward the retracted positions.

Thus, while the LED arrays 52 move from the exposing positions to the retracted positions, the tip ends thereof, at which the exposure surfaces 55*a*, 55*b*, 55*c*, 55*d* are located, are directed toward the first pivot axis 4. Therefore, the tip ends of the LED arrays 52 may be turned away from the user, and the exposing surfaces 55 of the LED arrays 52 may be maintained clean without being tainted.

Further, the linkage mechanism may include the engagement pins 54*a*, 54*b* arranged in the first and second LED array 52*a*, 52*b*, respectively, the linear-motion plate 32 configured to move in the direction orthogonal to the first pivot axis 4 in conjunction with the top cover 3 moving between the first position and the second position. The linear-motion plate 32 may have the pivoting cam edge 33*b* engageable with the engagement pin 54*a* and the pivoting cam edge 34*b* engageable with the engagement pin 54*b*. The pivoting cam edges 33*b*, 34*b* may move the first LED array 52*a* from the retracted position to the exposing position and to move the second LED array 52*b* from the retracted position to the exposing position, respectively, by being engaged with the engagement pins 54*a*, 54*b*, respectively, when the linear-motion plate 35 moves in conjunction with the top cover 3 moving from the second position toward the first position. The pivoting cam edges 33*b*, 34*b* are in the arrangement such that the timing, at which the pivoting cam edge 33*b* is engaged with the engagement pin 54*a*, is delayed to be later than the timing, at which the pivoting cam edge 34*b* is engaged with the engagement pin 54*b*.

Further, the linkage mechanism may include the arm 72, which is supported by the main body 2 pivotably at the body-side end portion 72*a* and supported by the linear-motion plate 32 pivotably at the cover-side end portion 72*b* being on the end opposite to the body-side end portion 72*a*. The linear-motion plate 32 may be moved by the arm 72 in the direction orthogonal to the first pivot axis 4 in conjunction with the top cover 3 moving between the first position and the second position.

Thus, for example, between the first LED array 52 farther from the first pivot axis 4 and the second LED array 52 closer to the first pivot axis 4, the timing, at which the pivoting cam edge 33*b* engages with the engagement pin 54*a* is later than the timing, at which the pivoting cam edge 34*b* engages with the engagement pin 54*b*. Therefore, the first LED array 52*a* may start moving toward the exposing position at the later timing than the second LED array 52*b*, and the first LED array 52*a* may be prevented from being tainted.

Further, the linkage mechanism may include the first gear 76 attached to the first pivot axis 4, the second gear 77 meshed with the first gear 76. The second gear 77 may revolve around the first pivot axis 4 in conjunction with the top cover 3 moving between the first position and the second position. The linkage mechanism may further include the rack gear 232*a* formed in the linear-motion plate 232. The rack gear 232*a* may mesh with the second gear 77. The second gear 77 may be rotated about the rotation axis 77*a* of the second gear 77 and move the linear-motion plate 232 in the direction orthogonal to the first pivot axis 4 by revolving around the first pivot axis 4 in conjunction with the top cover 3 moving between the first position and the second position.

Thus, the first LED array 52*a* may start moving to the exposing position at the later timing than the second LED array 52*b*, and the first LED array 52*a* may be prevented from being tainted.

Further, the linkage mechanism may include the slider member 37 attached to the top cover 3, which is movable in the direction orthogonal to the first pivot axis 4, the link lever 38, 39 having the contact portion 38*b*, 39*b*, which may contact the slider member 37, and the coupling portion 38*c*, 39*c*, which may be coupled with the linear-motion plate 32, 132. The link lever 38, 39 may be supported by the top cover 3 pivotably about the pivot axis 38*a*, 39*a* extending in parallel with the first pivot axis 4. The linkage mechanism may further include the arm 73 supported by the main body 2 pivorably at the body-side end portion 73*a* and supported by the slider member 37 pivotably at the cover-side end portion 73*b* being on the end opposite to the body-side end portion 73*a*. The slider member 37 may be moved by the arm 73 in the direction orthogonal to the first pivot axis 4 in conjunction with the top cover 3 moving from the second position toward the first position. The link lever 38, 39 may be moved by the slider member 37, which is moved in the direction orthogonal to the first pivot axis 4 and contacts the contacting portion 38*b*, 39*b*, to pivot about the pivot axis 38*a*, 39*a*. The liner-motion plate 32, 132 may be moved by the link lever 38, 39, which is moved to pivot about the pivot axis 38*a*, 39*a* in the direction orthogonal to the first pivot axis 4.

Thus, the first LED array 52*a* may start moving to the exposing position at the later timing than the second LED array 52*b*, and the first LED array 52*a* may be prevented from being tainted.

Although examples of carrying out the invention have been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. An image forming apparatus configured to form an image electro-photographically, comprising:

a main body having an opening portion at an upper side thereof;

a top cover including a first end portion and a second end portion opposite to the first end portion, the top cover being supported by the main body at the first end portion pivotably about a first pivot axis, the top cover being configured to move the second end portion between a first position, in which the top cover covers the opening portion, and a second position, in which the top cover exposes the opening portion;

a first exposure device supported by the top cover at a basal end portion of the first exposure device pivotably about a second pivot axis, the second pivot axis extending in parallel with the first pivot axis, the first exposure device being configured to move between a first exposing position, in which a tip end portion of the first exposure device opposite to the basal end portion is separated farther from the top cover, and a first retracted position, in which the tip end portion of the first exposure device is closer to the top cover;

a second exposure device arranged at a position closer to the first pivot axis than the first exposure device, the second exposure device being supported by the top cover at a basal end portion of the second exposure device pivotably about a third pivot axis, the third pivot axis extending in parallel with the first pivot axis, the second exposure device being configured to move between a second exposing position, in which a tip end portion of the second exposure device opposite to the basal end portion is separated farther from the top cover, and a second retracted position, in which the tip end portion of the second exposure device is closer to the top cover; and a linkage mechanism linked with the first exposure device and with the second exposure device, the linkage mechanism being configured to move the second exposure device from the second retracted position toward the second exposing position and move the first exposure device from the first retracted position toward the first exposing position at a timing later than the second exposure device moving toward the second exposing position in conjunction with the top cover moving from the second position toward the first position.

2. The image forming apparatus according to claim 1, further comprising a third exposure device arranged at a position closer to the first pivot axis than the second exposure device, the third exposure device being supported by the top cover at a basal end portion of the third exposure device pivotably about a fourth pivot axis, the fourth pivot axis extending in parallel with the first pivot axis, the third exposure device being configured to move between a third exposing position, in which a tip end portion of the third exposure device opposite to the basal end portion is separated farther from the top cover, and a third retracted position, in which the tip end portion of the third exposure device is closer to the top cover, wherein the linkage mechanism is linked further with the third exposure device, the linkage mechanism being configured to move the third exposure device from the third retracted position toward the third exposing position at a timing earlier than the second exposure device moving toward the second exposing position in conjunction with the top cover moving from the second position toward the first position.

3. The image forming apparatus according to claim 1, wherein the first exposure device includes an exposure surface at the tip end portion of the first exposure device; and wherein the linkage mechanism being configured to direct the tip end portion of the first exposure device to be closer to the first pivot axis in conjunction with the top cover moving from the second position toward the first position to move the first exposure device from the first exposing position toward the first retracted position.

4. The image forming apparatus according to claim 1, wherein the linkage mechanism includes:

a first engagement portion arranged in the first exposure device;

a second engagement portion arranged in the second exposure device; and a linear-motion member configured to move in a direction orthogonal to the first pivot axis in conjunction with the top cover moving between the first position and the second position, the linear-motion member having a first engageable portion engageable with the first engagement portion and a second engageable portion engageable with the second engagement portion;

wherein the first engageable portion and the second engageable portion are configured to move the first exposure device from the first retracted position to the first exposing position and to move the second exposure device from the second retracted position to the second exposing position, respectively, by being engaged with the first engagement portion and the second engagement portion, respectively, when the linear-motion member moves in conjunction with the top cover moving from the second position toward the first position; and wherein the first engageable portion and the second engageable portion are in an arrangement such that a timing, at which the first engageable portion is engaged with the first engagement portion, is delayed to be later than a timing, at which the second engageable portion is engaged with the second engagement portion.

5. The image forming apparatus according to claim 4, wherein the linkage mechanism includes an arm, the arm being supported by the main body pivotably at a body-side end portion and supported by the linear-motion member pivotably at a cover-side end portion being on an end opposite to the body-side end portion; and wherein the linear-motion member is moved by the arm in the direction orthogonal to the first pivot axis in conjunction with the top cover moving between the first position and the second position.

6. The image forming apparatus according to claim 4, wherein the linkage mechanism includes:

a first gear attached to the first pivot axis;

a second gear meshed with the first gear, the second gear being configured to revolve around the first pivot axis in conjunction with the top cover moving between the first position and the second position; and a rack gear formed in the linear-motion member, the rack gear being meshed with the second gear; and wherein the second gear is rotated about a rotation axis of the second gear and moves the linear-motion member in the direction orthogonal to the first pivot axis by revolving around the first pivot axis in conjunction with the top cover moving between the first position and the second position.

7. The image forming apparatus according to claim 4, wherein the linkage mechanism includes:

a slider member attached to the top cover, the slider member being movable in the direction orthogonal to the first pivot axis;

a link lever having a contact portion, the contact portion being configured to contact the slider member, and a coupling portion, the coupling portion being coupled with the linear-motion member, the link lever being supported by the top cover pivotably about a fifth pivot axis extending in parallel with the first pivot axis; and an arm supported by the main body pivotably at a body-side end portion and supported by the slider member pivotably at a cover-side end portion being on an end opposite to the body-side end portion;

wherein the slider member is moved by the arm in the direction orthogonal to the first pivot axis in conjunction with the top cover moving from the second position toward the first position;

wherein the link lever is moved by the slider member to pivot about the fifth pivot axis, the slider member being moved in the direction orthogonal to the first pivot axis and contacting the contacting portion; and wherein the linear-motion member is moved by the link lever in the direction orthogonal to the first pivot axis, the link lever being moved to pivot about the fifth pivot axis.

* * * * *